US008899739B2

(12) United States Patent
Ohnishi

(10) Patent No.: US 8,899,739 B2
(45) Date of Patent: Dec. 2, 2014

(54) PRINTING METHOD AND PRINTING SYSTEM

(75) Inventor: Masaru Ohnishi, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 121 days.

(21) Appl. No.: 13/512,019

(22) PCT Filed: Nov. 22, 2010

(86) PCT No.: PCT/JP2010/070837

§ 371 (c)(1),
(2), (4) Date: May 24, 2012

(87) PCT Pub. No.: WO2011/065338

PCT Pub. Date: Jun. 3, 2011

(65) Prior Publication Data

US 2012/0262525 A1 Oct. 18, 2012

(30) Foreign Application Priority Data

Nov. 26, 2009 (JP) ..... 2009-268821

(51) Int. Cl.

| | |
|---|---|
| ***B41J 2/01*** | (2006.01) |
| ***B41M 5/03*** | (2006.01) |
| ***B41M 5/025*** | (2006.01) |
| ***B41M 7/00*** | (2006.01) |
| ***B41F 17/00*** | (2006.01) |
| ***B41F 19/00*** | (2006.01) |
| ***B41F 23/04*** | (2006.01) |

(52) U.S. Cl.

CPC ..... *B41M 5/03* (2013.01); *B41M 5/025* (2013.01); *B41M 5/0256* (2013.01); *B41M 7/0081* (2013.01); *B41F 17/001* (2013.01); *B41F 19/007* (2013.01); *B41F 23/04* (2013.01); *B41P 2235/24* (2013.01)

USPC ..... 347/103; 347/101; 347/102; 347/105; 347/106

(58) Field of Classification Search

None

See application file for complete search history.

(56) References Cited

U.S. PATENT DOCUMENTS

| | | | | |
|---|---|---|---|---|
| 7,048,651 | B2 * | 5/2006 | Kennedy et al. | 473/378 |
| 2007/0279473 | A1 * | 12/2007 | Tombs et al. | 347/107 |
| 2009/0207198 | A1 * | 8/2009 | Muraoka | 347/6 |
| 2014/0015908 | A1 * | 1/2014 | Ohnishi | 347/102 |

FOREIGN PATENT DOCUMENTS

| | | |
|---|---|---|
| JP | 10-202998 | 8/1998 |
| JP | 2002-526182 | 8/2002 |
| JP | 2006-123537 | 5/2006 |
| JP | 2006-130725 | 5/2006 |
| JP | 2009-051109 | 3/2009 |
| JP | 2009-226890 | 10/2009 |
| JP | 2009-235380 | 10/2009 |

* cited by examiner

*Primary Examiner* — Justin Seo

(74) *Attorney, Agent, or Firm* — Jianq Chyun IP Office

(57) ABSTRACT

A printing method and a printing system are provided in which a fast printing speed is achieved, a variety of ultraviolet curable inks can be used, and excellent transfer properties to a printing object can be achieved. First, print processing is performed, thereby printing an image on a transfer pad, next, provisional curing processing is performed, thereby provisionally curing an ultraviolet curable ink applied to the transfer pad, next, transfer processing is performed, thereby transferring the ultraviolet curable ink landed on the transfer pad to a printing object, and next, final curing processing is performed, thereby performing final curing of the ultraviolet curable ink transferred to the printing object. In this way, transfer printing of an image to the printing object can be performed by a single transfer. In addition, if the transfer printing is finished, cleaning processing is performed, thereby cleaning the transfer pad.

5 Claims, 5 Drawing Sheets

PRINTING METHOD AND PRINTING SYSTEM

CROSS-REFERENCE TO RELATED APPLICATION

This application is a 371 of international application of PCT application serial no. PCT/JP2010/070837, filed on Nov. 22, 2010, which claims the priority benefit of Japan application no. 2009-268821, filed on Nov. 26, 2009. The entirety of each of the above mentioned patent applications is hereby incorporated by reference herein and made a part of this specification.

TECHNICAL FIELD

The present invention relates to a printing method and a printing system.

BACKGROUND ART

In the past, as a method of performing printing on the surface of a resin product, a metal product, or the like, pad printing has been known. In the pad printing, printing is performed as follows. First, after an ink is applied onto an intaglio plate with a printing pattern carved therein, the ink is pushed into the printing pattern of the intaglio plate by using a blade or the like and the ink on places other than the inside of the printing pattern is removed. Subsequently, a transfer pad having elasticity is pressed against the intaglio plate from above, so that the ink in the printing pattern is transferred to the transfer pad. Thereafter, the transfer pad with the printing pattern transferred thereto is pressed against a printing object, so that the ink forming the printing pattern is transferred to the printing object, whereby printing is performed.

Further, as a printing method on a printing object having a curved surface, a method is disclosed in which printing is directly performed on a planar original plate by an ink jet system, a viscosity increasing treatment is performed on the ink on the planar original plate, the ink is transferred from the planar original plate to a soft pad having a curved surface of a shape approximately similar to that of the printing curved surface of the printing object, and the soft pad is brought into contact with the printing surface of the printing object, so that transfer and fixing are performed (refer to PTL 1).

In addition, in recent years, a method has been disclosed in which an ultraviolet curable ink image is printed on a planar original plate by ink jet, UV irradiation is performed on the ultraviolet curable ink image, thereby making the ultraviolet curable ink image be in a half-dry state, the ultraviolet curable ink image in the half-dry state is transferred to the surface of an elastic blanket, the ultraviolet curable ink image transferred to the elastic blanket is offset-printed to a printing object, and the offset-printed ultraviolet curable ink image is dried and fixed (refer to PTL 2).

CITATION LIST

Patent Literature

[PTL 1] JP-A-10-202998
[PTL 2] JP-A-2006-130725

SUMMARY OF INVENTION

Technical Problem to be Solved

In the conventional pad printing, generally, ink is transferred from an original plate such as an intaglio plate to a transfer pad. However, in such a printing method, in the case of changing a printing pattern, there is a need to separately prepare an original plate, so that it is difficult to continuously print different printing patterns.

In this regard, it is considered that if an inkjet system is used, it is possible to create a variety of printing patterns without separately preparing an original plate. However, in the method described in PTL 1, there is a problem in that time as much as 5 minutes is required for increasing viscosity by hot air, and thus a printing speed is very slow. Further, there is a need to use specific ink having a given viscosity due to the viscosity increasing.

Further, the method described in PTL 2 has a problem in that when the ultraviolet curable ink image transferred to the elastic blanket is offset-printed to the printing object, the ink is not sufficiently transferred to the printing object, and thus print unevenness or image disturbance occurs. Specifically, the ultraviolet curable ink on the planar original plate is subjected to UV irradiation from above, thereby increasing its viscosity. However, in the surface in contact with the planar original plate and the surface subjected to the UV irradiation, the viscosity of the latter surface further increases. If this is transferred to the elastic blanket, since the surface in contact with the elastic blanket becomes higher in viscosity than the surface which comes into contact with the printing object, it is considered that transfer from the elastic blanket to the printing object is not sufficiently performed, and thus it is not possible to perform clear printing.

The present invention has been made in view of the above-mentioned circumstances and has an object to provide a printing method and a printing system in which a pad printing is carried out with use of an inkjet system, at a high printing speed, and in which a variety of ultraviolet curable inks can be used, and an excellent transfer property to a printing object is achieved.

Solution to Problem

According to an aspect of the present invention, there is provided a printing method including: an application step in which an ultraviolet curable ink is applied to an elastic transfer pad by an ink jet system; and a transfer step in which the transfer pad and a printing object are brought into pressure contact with each other, to thereby transfer the ultraviolet curable ink applied to the transfer pad to the printing object.

In the printing method according to the above aspect of the present invention, the ultraviolet curable ink is applied to the transfer pad in the application step and the ultraviolet curable ink applied to the transfer pad is transferred to the printing object in the transfer step. For this reason, it is possible to perform printing on the printing object by a single transfer, so that reduction of the printing process and printing time can be realized. Further, in the conventional pad printing, print unevenness or image disturbance easily occurs due to plural numbers of transfers such as transfer from an original plate to a transfer pad and transfer from the transfer pad to the printing object, and in order to prevent this, there is a need to use a specific ink. On the contrary, in the printing method according to the present invention, it is possible to perform printing on the printing object by a single transfer, and thus it is possible to perform printing with excellent transfer properties by using a variety of ultraviolet curable inks.

According to another aspect of the present invention, there is provided a printing method including: an application step in which an ultraviolet curable ink is applied to an elastic transfer pad by an ink jet system; a provisional curing step in which provisional curing is performed by irradiating the ultraviolet curable ink applied to the transfer pad with ultraviolet light; a transfer step in which the transfer pad and a printing object are brought into pressure contact with each other, to thereby transfer the ultraviolet curable ink provisionally cured in the provisional curing step to the printing object; and a final curing step in which final curing is performed by irradiating the ultraviolet curable ink transferred to the printing object with ultraviolet light.

According to such printing method, the ultraviolet curable ink is applied to the transfer pad in the application step and the ultraviolet curable ink applied to the transfer pad is transferred to the printing object in the transfer step. For this reason, it is possible to perform printing on the printing object by a single transfer, and thus reduction of a printing process and of a printing time can be realized. Further, in the conventional pad printing, print unevenness or image disturbance easily occurs due to transfer of plural times such as transfer from an original plate to a transfer pad and transfer from the transfer pad to a printing object, and in order to prevent this, there is a need to use a specific ink. On the contrary, in the printing method according to the present invention, since it is possible to perform printing on the printing object by a single transfer, it is possible to perform printing with excellent transfer properties by using a variety of ultraviolet curable inks. Further, in the printing method according to the above aspect of the present invention, by irradiating the ultraviolet curable ink applied to the transfer pad with ultraviolet light in the provisional curing step, the gradient of viscosity occurs between the surface to be irradiated with the ultraviolet light in the ultraviolet curable ink and the contact surface of the ultraviolet curable ink with the transfer pad, and the viscosity of the former surface becomes higher. For this reason, in the subsequent transfer step, the ultraviolet curable ink in contact with the printing object at the surface to be irradiated with the ultraviolet light is excellently transferred to the printing object. In addition, in the printing method according to the above aspect of the present invention, by performing the final curing by irradiating the ultraviolet curable ink transferred to the printing object with ultraviolet light in the final curing step, the fixing property of the ultraviolet curable ink to the printing object becomes favorable.

In the printing method according to the above aspect of the present invention, it is preferable that the viscosity at 25° C. of the ultraviolet curable ink in the application step be in a range of 3 to 20 mPa·sec. The ultraviolet curable ink having such viscosity is suitable for an ink jet system and can reproducibly form an accurate image.

In the printing method according to the above aspect of the present invention, it is preferable that the viscosity at 25° C. of the ultraviolet curable ink provisionally cured in the provisional curing step be in a range of 30 to 300 mPa·sec. By performing the provisional curing in the provisional curing step, such that the viscosity is in the above viscosity range, the transfer property from the transfer pad to the printing object in the subsequent transfer step becomes much better.

According to still another aspect of the present invention, there is provided a printing system including: ink discharging means for discharging an ultraviolet curable ink to an elastic transfer pad; first ultraviolet irradiation means for irradiating the ultraviolet curable ink landed on the transfer pad with ultraviolet light, to thereby provisionally curing the ultraviolet curable ink; transfer means for bringing the transfer pad and a printing object into pressure contact with each other, to thereby transfer the ultraviolet curable ink irradiated with the ultraviolet light by the first ultraviolet irradiation means to the printing object; and second ultraviolet irradiation means for irradiating the ultraviolet curable ink transferred to the printing object with ultraviolet light, to thereby performing final curing of the ultraviolet curable ink. According to such printing system, it is possible to suitably implement the printing method according to the present invention.

Advantageous Effects of Invention

According to the present invention, it is possible to provide a printing method and a printing system in which a fast printing speed is achieved, a variety of ultraviolet curable ink can be used, and excellent transfer properties to the printing object is achieved.

DESCRIPTION OF EMBODIMENTS

Figure 1:
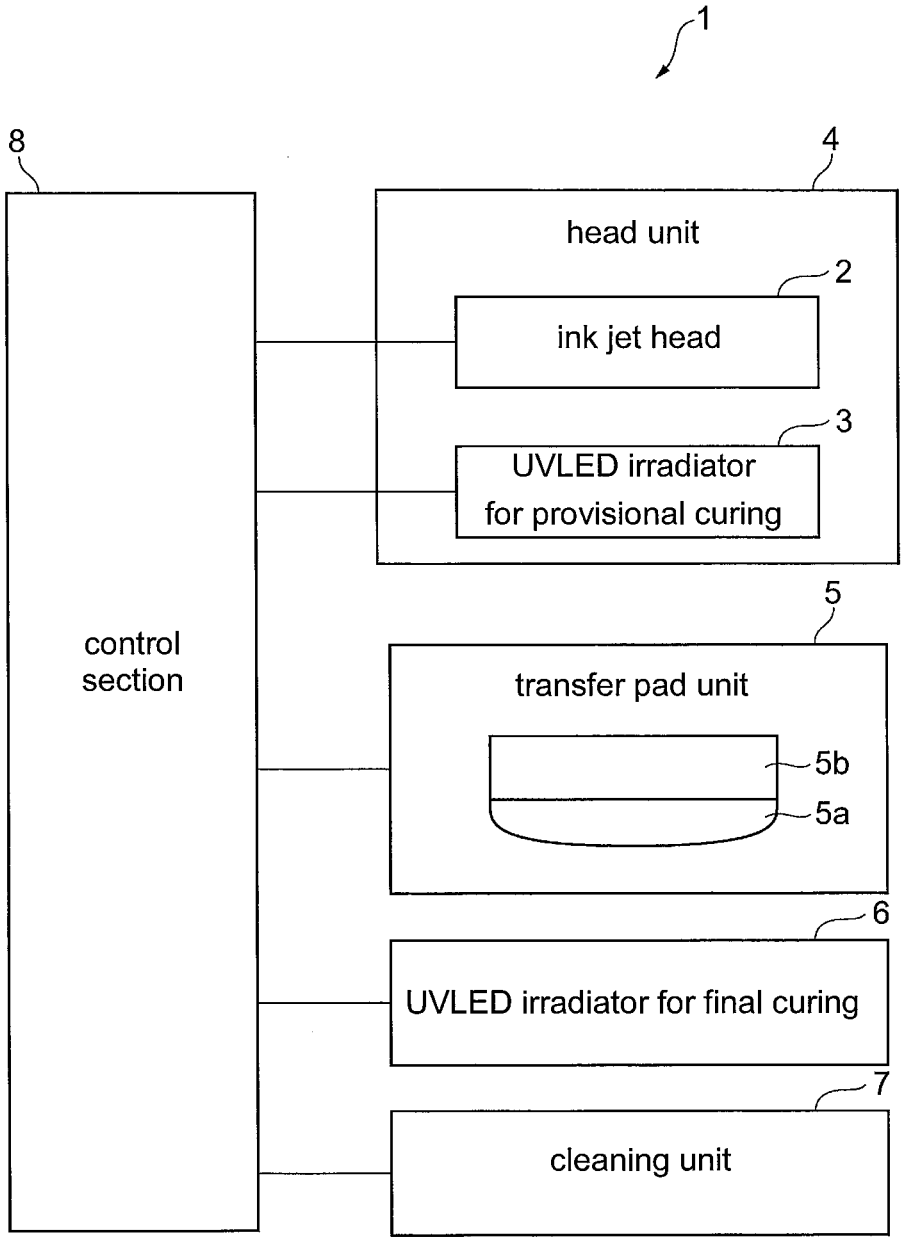
FIG. 1 is a diagram showing the functional configuration of an ink jet printer according to an embodiment of the invention.

Hereinafter, preferred embodiments of a printing method and a printing system according to the present invention will be described in detail with reference to the drawings. It is noted that in all the drawings, the same or equivalent section is denoted by the same reference numeral.

FIG. 1 is a diagram showing the functional configuration of an ink jet printer related to an embodiment. An ink jet printer 1 related to this embodiment is a printer of an ink jet system that discharges an ultraviolet curable ink which gets cured when it is exposed to ultraviolet light, and performs transfer printing (pad printing) of an image on a printing object of an arbitrary shape by once printing the image to a transfer pad and then transferring the image from the transfer pad to the printing object. For this reason, the ink jet printer 1 includes a head unit 4 with an ink jet head 2 and a UVLED irradiator 3 for provisional curing mounted thereon, a transfer pad unit 5, a UVLED irradiator 6 for final curing, a cleaning unit 7, and a control section 8.

The ink jet head 2 is for discharging an ultraviolet curable ink, thereby printing an image on the transfer pad unit 5. The ultraviolet curable ink discharged from the ink jet head 2 is an ink that gets cured when it is exposed to ultraviolet light, and various types of inks such as a cationic polymerization type ink, a radical polymerization type ink, and an ink with the cationic polymerization type ink and the radical polymerization type ink mixed therein can be used. In order to enable the discharge from the ink jet head 2, the viscosity at 25° C. of the ultraviolet curable ink is adjusted within a range of 3 to 20 mPa·sec. In addition, the ultraviolet curable ink can contain a solvent for viscosity adjustment at an amount of 30% by weight or less within a range that does not inhibit the curing by ultraviolet light exposure. The color of the ultraviolet curable ink is not particularly limited and, for example, normal colors of Y (yellow), M (magenta), C (cyan), and K (black), light colors of these normal colors, specific colors such as white, metallic color, and clear color, the combination of these colors, or the like can be used.

The UVLED irradiator 3 for provisional curing is a device with a UVLED that emits ultraviolet light mounted thereon and is for provisionally curing the ultraviolet curable ink on the transfer pad unit 5 by irradiating the transfer pad unit 5 with ultraviolet light. In addition, if the ultraviolet light which is emitted from the UVLED irradiator 3 for provisional curing has a short wavelength of less than 350 nn, since it is difficult for the ultraviolet light to reach the inside of the ultraviolet curable ink, causing lack of exposure, the ultraviolet curable ink is not sufficiently provisionally cured. Therefore, the UVLED irradiator 3 for provisional curing emits ultraviolet light having a relatively long wavelength in a range of 350 nm to 410 nm such that the ultraviolet light reaches the inside of the ultraviolet curable ink. In addition, the UVLED irradiator 3 for provisional curing may also have an LED of visible light such as blue mixed therein to cause ultraviolet light to sufficiently reach the inside of the ultraviolet curable ink.

Then, the head unit 4 on which the ink jet head 2 and the UVLED irradiator 3 for provisional curing are mounted is movably held by a guide rail (not shown) extending in a scanning direction and is able to reciprocate in the scanning direction by a driving section (not shown). Then, in the head unit 4, the ink jet head 2 is disposed in front in the scanning direction and the UVLED irradiator 3 for provisional curing is disposed at the back in the scanning direction. For this reason, when the head unit 4 moves in the scanning direction, an image can be printed by discharging the ultraviolet curable ink from the ink jet head 2, thereby applying the ultraviolet curable ink to the transfer pad unit 5, and further, the ultraviolet curable ink can be provisionally cured by emitting ultraviolet light from the UVLED irradiator 3 for provisional curing, thereby irradiating the ultraviolet curable ink applied to the transfer pad unit 5 with the ultraviolet light.

The transfer pad unit 5 is for being applied with the ultraviolet curable ink discharged from the ink jet head 2 and also transferring the applied ultraviolet curable ink to a printing object. For this reason, the transfer pad unit 5 is constituted by a transfer pad 5*a* to which the ultraviolet curable ink is applied and a pad support section 5*b* which supports the transfer pad 5*a* and moves the transfer pad 5*a* by a driving section (not shown). The transfer pad 5*a* is formed of elastic silicone rubber having a given thickness and is able to be deformed following the shape of the printing object.

The UVLED irradiator 6 for final curing is a device with a UVLED that emits ultraviolet light mounted thereon and is for performing final curing of the ultraviolet curable ink on the printing object by irradiating the printing object with ultraviolet light. In addition, the UVLED irradiator 6 for final curing emits ultraviolet light having a relatively long wavelength in a range of 350 nm to 410 nm such that ultraviolet light reaches the inside of the ultraviolet curable ink, similarly to the UVLED irradiator 3 for provisional curing.

In addition, the UVLED irradiator 6 for final curing is movably held by a guide rail (not shown) extending in the scanning direction and is able to reciprocate in the scanning direction by a driving section (not shown), similarly to the head unit 4. Then, the UVLED irradiator 6 for final curing can perform final curing of the provisionally cured ultraviolet curable ink by emitting ultraviolet light when moving in the scanning direction, thereby irradiating the ultraviolet curable ink transferred to the printing object with the ultraviolet light.

The cleaning unit 7 is for cleaning the transfer pad 5*a* and wipes the transfer pad 5*a* by a long cleaning sheet (not shown), thereby wiping out the ultraviolet curable ink remaining on the transfer pad 5*a* without being transferred, or dirt or the like stuck to the transfer pad 5*a*.

The control section 8 is electrically connected to the ink jet head 2, the UVLED irradiator 3 for provisional curing, the head unit 4, the transfer pad unit 5, the UVLED irradiator for final curing, and the cleaning unit 7 and is for controlling these elements, thereby performing transfer printing of a given image on the printing object.

Figure 2:
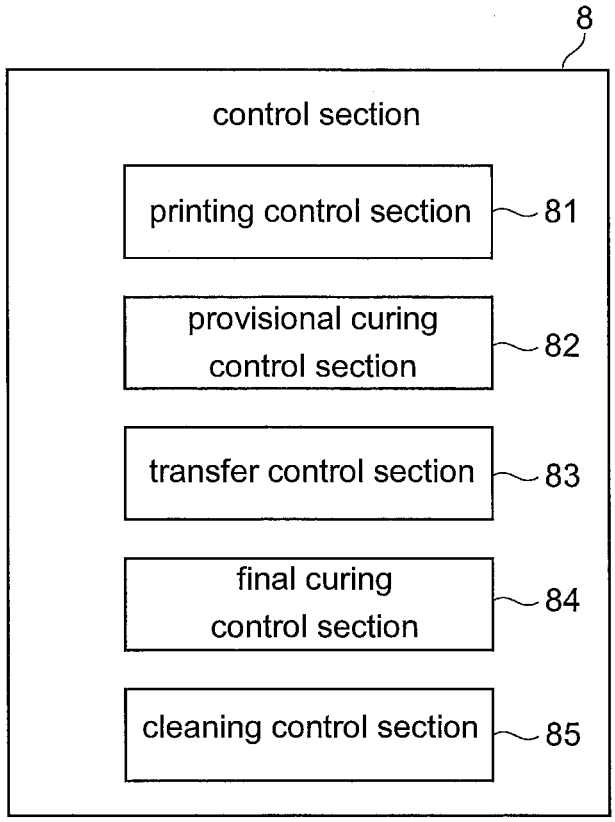
FIG. 2 is a diagram showing the functional configuration of a control section.

FIG. 2 is a diagram showing the functional configuration of the control section. As shown in FIG. 2, the control section 8 functions as a printing control section 81, a provisional curing control section 82, a transfer control section 83, a final curing control section 84, and a cleaning control section 85. In addition, the control section 8 is configured with, for example, a computer which includes a CPU, a ROM, and a RAM as the principal body, and a computer program for realizing each function described above is stored in the ROM or the like. Then, the each function described above is realized by reading out the computer program into the CPU or the RAM and making the program operate under the control of the CPU.

The printing control section 81 is for performing the print processing of printing an image on the transfer pad 5*a*. That is, the printing control section 81 controls to arrange the transfer pad 5*a* at a scanning position by the ink jet head 2, by the driving control of the pad support section 5*b*, and discharge the ultraviolet curable ink from the ink jet head 2 while moving the head unit 4 in the scanning direction, by the driving control of the head unit 4 and the discharging control of the ink jet head 2. In addition, the scanning position where the transfer pad 5*a* is arranged is a position below a position where the ink jet head 2 passes when the head unit 4 moves.

The provisional curing control section 82 is for performing the provisional curing processing of provisionally curing the ultraviolet curable ink applied to the transfer pad 5*a*. That is, the provisional curing control section 82 controls to provisionally cure the ultraviolet curable ink by irradiating the ultraviolet curable ink on the transfer pad 5*a* with ultraviolet light by emitting the ultraviolet light from the UVLED irradiator 3 for provisional curing by ultraviolet light emission control of the UVLED irradiator 3 for provisional curing, when the head unit 4 moves in the scanning direction by the print processing that the printing control section 81 performs. In addition, the provisional curing control section 82 controls the movement speed of the head unit 4 and the light quantity of the ultraviolet light which is irradiated from the UVLED irradiator 3 for provisional curing such that the viscosity at 25° C. of the ultraviolet curable ink landed on the transfer pad 5*a* is thickened within a range of 30 to 300 mPa·sec.

The transfer control section 83 is for performing the transfer processing of transferring the ultraviolet curable ink applied to the transfer pad 5*a* to the printing object. That is, the transfer control section 83 moves the transfer pad 5*a* from the scanning position to above the printing object by the driving control of the pad support section 5*b* and also presses the transfer pad 5*a* against the printing object, thereby transferring the ultraviolet curable ink on the transfer pad 5*a* to the printing object.

The final curing control section 84 is for performing the final curing processing of performing final curing of the ultraviolet curable ink transferred to the printing object. That is, the final curing control section 84 controls to perform final curing of the ultraviolet curable ink by irradiating the ultraviolet curable ink on the printing object with ultraviolet light by emitting the ultraviolet light from the UVLED irradiator 6 for final curing while moving the UVLED irradiator 6 for final curing in the scanning direction, by the driving control and the ultraviolet light emission control of the UVLED irradiator 6 for final curing. In addition, the final curing control section 84 controls the movement speed of the UVLED irradiator 6 for final curing and the light quantity of the ultraviolet light which is irradiated from the UVLED irradiator 6 for final curing such that the ultraviolet curable ink transferred to the printing object is completely cured.

The cleaning control section 85 is for performing the cleaning processing of cleaning the transfer pad 5*a*. That is, the cleaning control section 85 controls to wipe out the ultraviolet curable ink remaining on the transfer pad 5*a* without being transferred, or dirt or the like stuck to the transfer pad 5*a* by pressing the transfer pad 5*a* against the cleaning sheet and moving the cleaning sheet, by the driving control of the pad support section 5*b* and the driving control of the cleaning unit 7.

Figure 3:
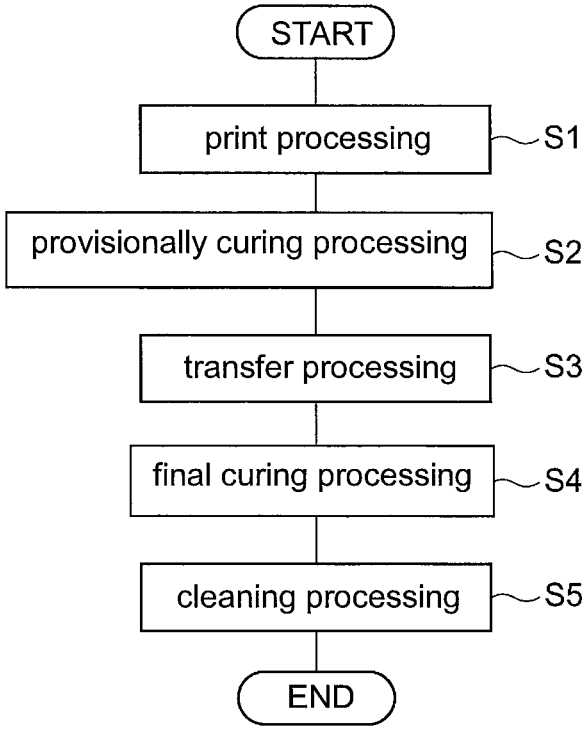
FIG. 3 is a flowchart showing a processing operation of the control section.

Next, a transfer printing method using the ink jet printer 1 will be described with reference to FIGS. 3, 4A to 4D, and 5A to 5C. FIG. 3 is a flowchart showing a processing operation of the control section, and FIGS. 4A to 4D and 5A to 5C are diagrams showing an example of an operation of the ink jet printer. In addition, with respect to the processing described below, a processing section (not shown) which is constituted by a CPU or the like executes the computer program recorded in a storage device such as a ROM in the control section 8, whereby the following processing is performed.

Figure 4A:
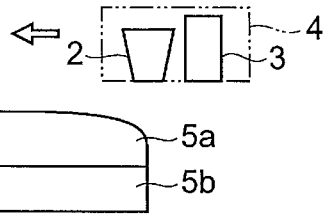
FIGS. 4A to 4D are diagrams showing an example of an operation of the ink jet printer.
Figure 4B:
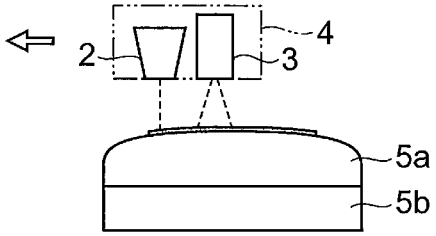

First, the control section 8 controls to perform the print processing, thereby printing an image on the transfer pad 5*a* (step S1). That is, in step S1, first, as shown in FIG. 4A, the transfer pad 5*a* is arranged at the scanning position by driving the pad support section 5*b*. Then, as shown in FIG. 4B, the ultraviolet curable ink is discharged from the inkjet head 2 while moving the head unit 4 in the scanning direction. In this way, the ultraviolet curable ink discharged from the ink jet head 2 is applied to the transfer pad 5*a*, so that a given image is printed. At this time, the viscosity of the ultraviolet curable ink applied to the transfer pad 5*a* is in a range of 3 to 20 mPa·sec at 25° C. In addition, the print processing of step S1 corresponds to the application step stated in the appended claims.

Then, the control section 8 controls to perform provisional curing processing when performing the print processing of step S1, thereby provisionally curing the ultraviolet curable ink applied to the transfer pad 5*a* (step S2). That is, in step S2, ultraviolet light is emitted from the UVLED irradiator 3 for provisional curing when the head unit 4 is moved in the scanning direction in step SI. In this way, application of the ultraviolet ink to the transfer pad 5*a* by the ink jet head 2 and emission of the ultraviolet light by the UVLED irradiator 3 for provisional curing are continuously performed by a single scan of moving the head unit 4 in the scanning direction. At this time, the control section 8 controls the movement speed of the head unit 4 and the light quantity of the ultraviolet light emitted from the UVLED irradiator 3 for provisional curing such that the ultraviolet curable ink on the transfer pad 5*a* is provisionally cured, whereby the viscosity at 25° C. is thickened within a range of 30 to 300 mPa·sec. In this way, the ultraviolet curable ink applied to the transfer pad 5*a* is exposed to the ultraviolet light, thereby being provisionally cured. At this time, the ultraviolet curable ink is provisionally cured into the form of a soft paste having adhesion. However, gradient of viscosity occurs according to the degree of exposure to the ultraviolet light, so that viscosity and adhesion become higher in the surface to be irradiated with the ultraviolet light in the ultraviolet curable ink than in the contact surface with the transfer pad 5*a*. In addition, the provisional curing processing of step S2 corresponds to the provisional curing step stated in the appended claims.

Figure 4C:
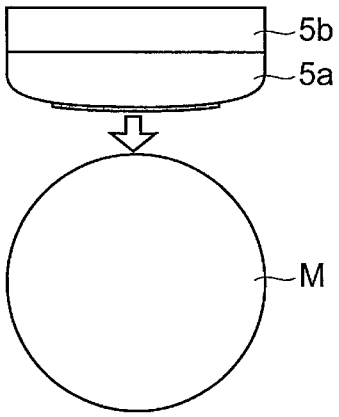
Figure 4D:
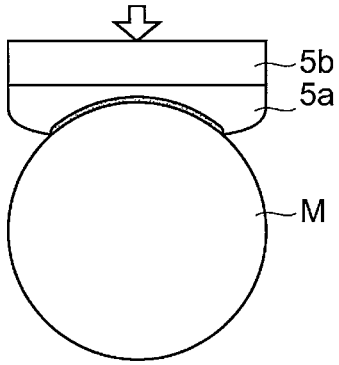

Next, the control section 8 controls to perform transfer processing, thereby transferring the ultraviolet curable ink landed on the transfer pad 5*a* to a printing object M (step S3). That is, in step S3, as shown in FIG. 4C, the transfer pad 5*a* is moved from the scanning position to above the printing object M by driving the pad support section 5*b*, and further, as shown in FIG. 4D, the transfer pad 5*a* is pressed against the printing object M. In this way, since the transfer pad 5*a* is pressed against the printing object M, the transfer pad 5*a* is deformed along the surface shape of the printing object M, so that the transfer pad 5*a* and the printing object M come into close contact with each other, whereby the ultraviolet curable ink on the transfer pad 5*a* is transferred to the printing object M. At this time, since the ultraviolet curable ink has viscosity and adhesion higher in the contact surface with the printing object M that is the surface to be irradiated with the ultraviolet light than in the contact surface with the transfer pad 5*a*, the ultraviolet curable ink is suitably transferred from the transfer pad 5*a* to the printing object M. Then, since the ultraviolet curable ink which is transferred is not yet finally cured, thereby being in a soft paste form, the transfer pad 5*a* is pressed against the printing object M, whereby the ultraviolet curable ink is flattened. In this way, matting of an image that is a defect of the ink jet printer 1 is eliminated, so that a high-gloss image can be obtained. On the other hand, when an image with a matte finish is desired, it can be met by treating the surface of the transfer pad 5*a* in a matte state. In addition, the transfer processing of step S3 corresponds to the transfer step stated in the appended claims.

Figure 5A:
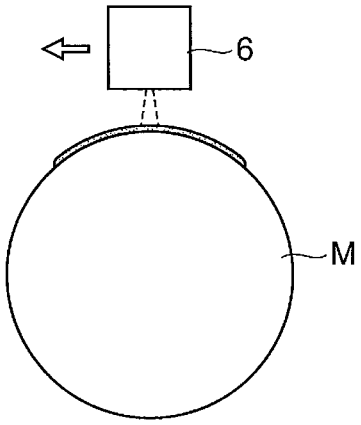
FIGS. 5A to 5C are diagrams showing an example of an operation of the ink jet printer.

Next, the control section 8 controls to perform final curing processing, thereby performing final curing of the ultraviolet curable ink transferred to the printing object M (step S4). That is, in step S4, as shown in FIG. 5A, ultraviolet light is emitted from the UVLED irradiator 6 for final curing while moving the UVLED irradiator 6 for final curing in the scanning direction. At this time, the control section 8 controls the movement speed of the UVLED irradiator 6 for final curing and the light quantity of the ultraviolet light emitted from the UVLED irradiator 6 for final curing such that the ultraviolet curable ink on the printing object M is finally cured. In this way, the ultraviolet curable ink transferred to the printing object M is exposed to the ultraviolet light, and finally cured. In addition, the final curing processing of step S4 corresponds to the final curing step stated in the appended claims.

Next, the control section 8 controls to perform final curing processing, thereby performing final curing of the ultraviolet curable ink transferred to the printing object M (step S4). That is, in step S4, as shown in FIG. 5A, ultraviolet light is emitted from the UVLED irradiator 6 for final curing while moving the UVLED irradiator 6 for final curing in the scanning direction. At this time, the control section 8 controls the movement speed of the UVLED irradiator 6 for final curing and the light quantity of the ultraviolet light emitted from the UVLED irradiator 6 for final curing such that the ultraviolet curable ink on the printing object M is finally cured. In this way, the ultraviolet curable ink transferred to the printing object M is exposed to the ultraviolet light, and finally cured. In addition, the final curing processing of step S4 corresponds to the final curing step stated in the appended claims.

Figure 5B:
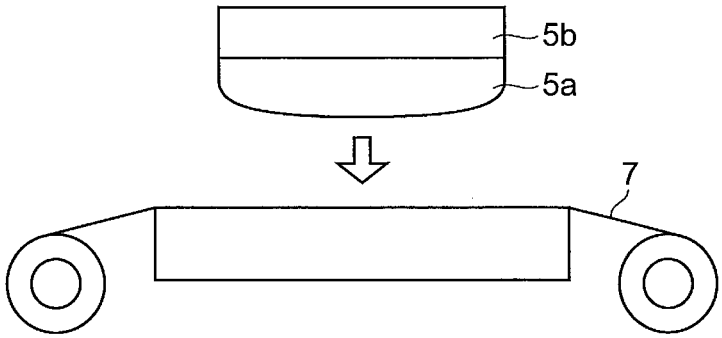
Figure 5C:
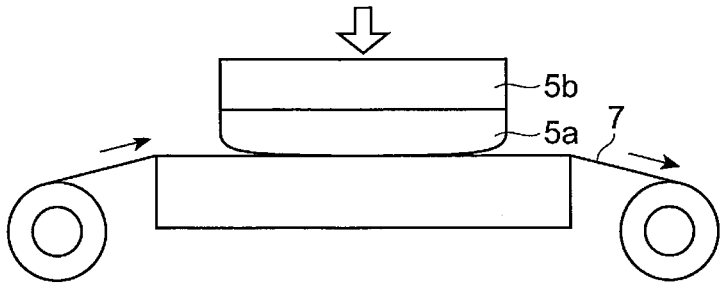

Next, the control section 8 controls to perform cleaning processing, thereby cleaning the transfer pad 5*a* (step S5). That is, in step S5, first, as shown in FIG. 5B, the transfer pad 5*a* is moved to above the cleaning unit 7 by driving the pad support section 5*b*, and further, as shown in FIG. 5C, the transfer pad 5*a* is pressed against the cleaning sheet. Then, the cleaning sheet of the cleaning unit 7 is taken up in this state, whereby the ultraviolet curable ink remaining on the transfer pad 5*a* without being transferred, or dirt or the like stuck to the transfer pad 5*a* is wiped out by the cleaning sheet.

In this manner, according to this embodiment, since the ultraviolet curable ink is applied to the transfer pad 5*a* in the print processing and the ultraviolet curable ink applied to the transfer pad 5*a* is transferred to the printing object in the transfer processing, it is possible to perform printing on the printing object by a single transfer, so that reduction of a printing process and a printing time can be realized. In addition, by performing printing on the printing object by a single transfer, it is possible to perform printing with excellent transfer properties by using a variety of ultraviolet curable inks. Further, the ultraviolet curable ink applied to the transfer pad 5*a* is irradiated with ultraviolet light in the provisional curing processing, whereby the viscosity and the adhesion of the ultraviolet curable ink become higher in the surface to be irradiated with the ultraviolet light than in the contact surface with the transfer pad 5*a*. For this reason, in the subsequent transfer processing, the ultraviolet curable ink in contact with the printing object at the surface to be irradiated with the ultraviolet light is excellently transferred to the printing object. Further, the ultraviolet curable ink transferred to the printing object is irradiated with ultraviolet light in the final curing processing to be finally cured, whereby the fixing property of the ultraviolet curable ink to the printing object becomes favorable.

Further, by discharging the ultraviolet curable ink, the viscosity at 25° C. of which is in a range of 3 to 20 mPa·sec, from the ink jet head 2, it is possible to improve the discharge characteristics of the ink jet head 2, so that it is possible to reproducibly form an accurate image.

Further, by the provisional curing processing, the ultraviolet curable ink applied to the transfer pad 5*a* is provisionally cured such that the viscosity at 25° C. is within a range of 30 to 300 mPa·sec, whereby the transfer property from the transfer pad 5*a* to the printing object in the subsequent transfer processing becomes much better.

Further, if a UVLED is used to irradiate ultraviolet curable ink with ultraviolet light, such as the UVLED irradiator 3 for provisional curing and the UVLED irradiator 6 for final curing, since the ON/OFF state of the ultraviolet light irradiation can be switched at high speed, it is possible to emit ultraviolet light only when irradiation of ultraviolet light is needed, and thus energy saving can be achieved.

Although the preferred embodiment of the present invention has been described above, the present invention is not limited to the above-described embodiment. For example, in the above-described embodiment, the present invention has been described as being applied only to the ink jet printer 1. However, the present invention may also be applied to a printing system (a pad printing system) which includes an ink jet printer.

Further, in the above-described embodiment, a description has been made as performing transfer printing through provisional curing and final curing by irradiating ultraviolet curable ink with ultraviolet light. However, the transfer printing may also be performed without irradiation of ultraviolet light.

Further, although in the above-described embodiment, the type of an LED which is used in the UVLED irradiator 3 for provisional curing and the UVLED irradiator 6 for final curing has not been specifically designated, any LED may be used. For example, in the case of using an LED having a sufficiently high output, an LED emitting visible lights of blue, green, and white may also be used. Further, if short-wavelength ultraviolet light is cut out, a metal halide lamp, a xenon lamp, or the like may also be used in place of LEDs, and a black light emitting UV-C light may also be used.

Further, in the above-described embodiment, a description has been made to use silicone rubber as the transfer pad 5*a*. However, any material may be used, as long as it has an elasticity and an excellent transfer characteristic for an ultraviolet curable ink, and, for example, rubber such as silicone rubber, fluorine-containing rubber, butyl rubber, chloroprene rubber, urethane rubber, neoprene, or EPDM, various elastomer resins, or the like can be selected.

In addition, in the above-described embodiment, heat retention at a constant temperature may also be performed in order to stabilize the transfer conditions. Further, in a case where ultraviolet curable inks of plural colors are used, the transfer printing may also be performed for each color or the transfer printing may be performed for plural colors such as two, four, or six colors at once.

The invention claimed is:

1. A printing method comprising:

an application step in which an ultraviolet curable ink is applied to an elastic transfer pad by an ink-jetting, wherein the transfer pad is able to be deformed following the shape of a printing object;

a provisional curing step in which provisional curing is performed by irradiating the ultraviolet curable ink applied to the transfer pad with ultraviolet light such that a gradient of viscosity is generated between a surface of the ultraviolet curable ink facing ultraviolet light and a contact surface of the ultraviolet curable ink with the transfer pad, wherein the viscosity of the surface of the ultraviolet curable ink facing ultraviolet light is higher than the viscosity of the contact surface of the ultraviolet curable ink with the transfer pad;

a transfer step in which the transfer pad and the printing object are brought into close contact with each other by pressure such that the transfer pad is deformed along a surface shape of the printing object, to thereby transfer the ultraviolet curable ink provisionally cured in the provisional curing step to the printing object; and a final curing step in which final curing is performed by irradiating the ultraviolet curable ink transferred to the printing object with ultraviolet light.

2. The printing method according to claim 1, wherein a viscosity at 25° C. of the ultraviolet curable ink in the application step is in a range of 3 to 20 mPa·sec.

3. The printing method according to claim 1, wherein a viscosity at 25° C. of the ultraviolet curable ink provisionally cured in the provisional curing step is in a range of 30 to 300 mPa·sec.

4. A printing system comprising:

ink discharging means for discharging an ultraviolet curable ink, thereby applying the ultraviolet curable ink to an elastic transfer pad, wherein the transfer pad is able to be deformed following the shape of a printing object;

first ultraviolet irradiation means for irradiating the ultraviolet curable ink applied to the transfer pad with ultraviolet light, thereby provisionally curing the ultraviolet curable ink such that a gradient of viscosity is generated between a surface of the ultraviolet curable ink facing ultraviolet light and a contact surface of the ultraviolet curable ink with the transfer pad, wherein the viscosity of the surface of the ultraviolet curable ink facing ultraviolet light is higher than the viscosity of the contact surface of the ultraviolet curable ink with the transfer pad;

transfer means for bringing the transfer pad and the printing object into close contact with each other by pressure such that the transfer pad is deformed along a surface shape of the printing object, thereby transferring the ultraviolet curable ink irradiated with the ultraviolet light by the first ultraviolet irradiation means to the printing object; and second ultraviolet irradiation means for irradiating the ultraviolet curable ink transferred to the printing object with ultraviolet light, thereby performing final curing of the ultraviolet curable ink.

5. The printing method according to claim 2, wherein a viscosity at 25° C. of the ultraviolet curable ink provisionally cured in the provisional curing step is in a range of 30 to 300 mPa·sec.

* * * * *